US006065413A

United States Patent [19]

Kawaguchi

[11] Patent Number: 6,065,413

[45] Date of Patent: May 23, 2000

[54] HEADGEAR HOLDER WITH ADJUSTABLE SUPPORT PLATES

[75] Inventor: Yasuhiko Kawaguchi, Nagoya, Japan

[73] Assignee: Brother Kogyo Kabushiki Kaisha, Nagoya, Japan

[21] Appl. No.: 09/231,108

[22] Filed: Jan. 14, 1999

[30] Foreign Application Priority Data

Jan. 15, 1998 [JP] Japan ..... 10-020296
Jan. 20, 1998 [JP] Japan ..... 10-023860

[51] Int. Cl.[7] ..... D05C 9/04

[52] U.S. Cl. ..... 112/470.14; 112/103

[58] Field of Search ..... 112/470.14, 470.18, 112/470.17, 475.11, 103

[56] References Cited

U.S. PATENT DOCUMENTS 5,277,140 1/1994 Nakagaki ..... 112/103 X
5,501,163 3/1996 Molder et al. ..... 112/470.18 X
5,649,496 7/1997 Morita et al. ..... 112/103
5,832,853 11/1998 Pokrishevsky et al. ..... 112/475.11
5,937,774 8/1999 Hayashi ..... 112/470.14 X

*Primary Examiner*—Ismael Izaguirre
*Attorney, Agent, or Firm*—Oliff & Berridge, PLC

[57] ABSTRACT

A headgear holder mounted on an embroidering machine includes a guide shaft secured to the body of the embroidering machine and extending along a sewing-bed arm, a base frame supported on the guide shaft so as to be moved front-to-back with respect to the body, an annular rotating frame supported on the base frame so as to be rotated, a headgear holding member detachably attached to the rotating frame to hold the headgear, and a pair of headgear support plates provided ahead of the rotating frame so as to be spaced from each other right and left with respect to the rotating frame so that positions of the headgear support plates are vertically adjustable independently of each other.

30 Claims, 10 Drawing Sheets

HEADGEAR HOLDER WITH ADJUSTABLE SUPPORT PLATES

BACKGROUND OF THE INVENTION

1. Field of the Invention

This invention relates to a headgear holder attached to an embroidering machine when embroidery is sewn on a headgear such as a cap.

2 Description of the Related Art

A multi-head embroidering machine has conventionally been provided which comprises a plurality of embroidering machine units disposed on a base frame lengthwise with respect to the base frame, a moving frame movable in an X direction (right-to-left) perpendicular to sewing-bed arms of the respective embroidering machine units and in a Y direction (front-to-back) parallel to the sewing-bed arms, and embroidery frames detachably attached to the moving frames to correspond to the respective embroidering machine units. Further, various types of headgear holders have been provided which are detachably attached to each embroidering machine unit of the multi-head embroidering machine in order that embroidery may be formed on a headgear such as a cap.

The headgear holder generally comprises a guide shaft having a proximal end fixed to the body of the embroidering machine unit and extending forward along the sewing-bed arm, a base frame supported on the guide shaft so as to be movable forward and backward, a ring-shaped rotating frame rotatably supported on the base frame, and a headgear holding member detachably attached to the rotating frame. The base frame is connected via a connecting mechanism to the moving frame so as to be moved with the movable frame forward and backward. The headgear holder further comprises a rotating mechanism converting right-to-left movement of the moving frame to rotation of the rotatable frame. The headgear holding member is moved forward and backward and rotated about an axis extending forward and backward.

The prior art has provided a headgear holder in which a pair of headgear support plates disposed inside the headgear attached to the headgear holding member to support the headgear are provided in front of the rotating frame and near the sewing-bed arm in order that a high quality of embroidery may be formed on the headgear. The headgear support plates are disposed at right-hand and left-hand sides of the sewing-bed arm over the latter respectively so that a space is defined therebetween so as to correspond to a needle hole of the sewing-bed arm. The headgear support plates are connected, for example, at their proximal ends, to each other and also connected to distal or front ends of a pair of support bars connected to the base frame respectively.

The support bars are connected to the base frame so that positions of the support bars are vertically adjustable. Accordingly, the vertical positions of the support bars are suitably adjusted so that the headgear support plates are moved to positions where they do not interfere with the sewing-bed arm. Further, the headgear support plates are connected to the distal ends of the support bars respectively so that the front-to-back positions of the headgear supports are adjustable. As a result, the front-to-back positions of the headgear support plates can be adjusted according to the size and shape of a headgear on which embroidery is to be sewn. The above-described construction can ensure a high quality of embroidery to be sewn on the headgear.

However, the pair of headgear support plates are formed integrally with each other in the above-described headgear holder. This means that the vertical positions and the front-to-back positions of the headgear support plates cannot be adjusted independently of the plates. For example, when there is an error in the dimensions of the paired headgear support plates, the vertical positions of both plates cannot be adjusted relative to the sewing-bed arm. This results in a problem that a high quality of embroidery to be sewn on a headgear cannot be ensured. On the other hand, when an accuracy in the dimensions of the headgear support plates is improved for prevention of the dimensional error, a manufacturing cost of the headgear holder is increased. Further, the headgear support plates cannot smoothly be moved vertically with the paired support bars nor moved forward and backward relative to the support bars. Consequently, it is difficult to adjust the vertical positions and front-to-back positions of the headgear support plates.

SUMMARY OF THE INVENTION

Therefore, an object of the present invention is to provide a headgear holder in which the positions of a pair of headgear support plates can easily and accurately be adjusted independently of the plates.

The present invention provides a headgear holder mounted on an embroidering machine including a body and a sewing-bed arm extending front-to-back with respect to the body so that embroidery is sewn on a headgear. The headgear holder comprises a guide shaft secured to the body of the embroidering machine and extending along the sewing-bed arm, a base frame supported on the guide shaft so as to be moved front-to-back, an annular rotating frame supported on the base frame so as to be rotated, a headgear holding member detachably attached to the rotating frame to hold the headgear, and a pair of headgear support plates provided ahead of the rotating frame so as to be spaced from each other right and left with respect to the rotating frame so that positions of the headgear support plates are vertically adjustable independently of each other.

According to the above-described construction, the positions of the headgear support plates can be adjusted easily and accurately independently of each other. Accordingly, the plates can be disposed at respective suitable positions even when there is an error in the dimensions of the paired headgear support plates. Consequently, a high quality of embroidery can be sewn on a headgear held on the headgear holding member. Further, a fine adjustment of the positions of the headgear support plates can be realized since the positions are easily adjusted.

In a preferred form, the headgear holder further comprises a pair of vertical position adjustment connecting mechanisms for. connecting the headgear support plates so that the positions of the respective headgear support plates are vertically adjustable relative to the base frame. Consequently, the vertical positions of the headgear support plates can be adjusted independently of each other. Each vertical position adjustment connecting mechanism preferably includes a support bar provided. on the base frame so as to extend forward from a front of the base frame and having a front end to which the headgear support plate is connected. In this construction, the base frame has vertically elongate holes, and each support bar has a rear end provided with an insertion shaft inserted into one of the elongate holes of the base frame so as to be vertically movable and non-rotatable. Thus, each vertical position adjustment connecting mechanism can be constructed easily. Further, the vertical position of each headgear support plate can be adjusted easily since the rotation of each support bar is prevented when vertically moved.

In another preferred form, the support bars have abutting portions abutting the front of the base frame when the insertion shafts have been inserted into the elongate holes of the base frame, respectively and screw portions protruding in the rear of a back of the base frame when the insertion shafts have been inserted into the elongate holes of the base frame, respectively. In this construction, the vertical position adjustment connecting mechanisms include nuts engageable with the screw portions respectively, and the insertion shafts are inserted into the elongate holes and the nuts are engaged with the screw portions while the abutting portions of the support bars are abutted against the front of the base frame, so that the support bars are fixed to the base frame while being maintained in a horizontal state, respectively.

In further another preferred form, the headgear holder further comprises a pair of front-to-back position adjustment connecting mechanisms for connecting the headgear support plates so that front-to-back positions of the respective headgear support plates are adjustable relative to the base frame. Consequently, the front-to-back positions of the paired headgear support plates can be adjusted independently of each other.

In further another preferred form, the rotating frame has an engaged portion formed in an outer periphery thereof, and the base frame includes a supporting mechanism provided for supporting the rotating frame for rotation and having a plurality of guide members engaging the engaged portion of the rotating frame. In this construction, the headgear holder further comprises a position adjusting mechanism for adjusting a front-to-back position of at least one of the guide members of the base frame. For example, self-weights of the base frame and the rotating frame sometimes incline them downward together with the guide shaft. In such a case, the center of rotation of the rotating frame is shifted from a horizontal axis extending front-to-back. When embroidery is sewn on a headgear held on the headgear holding member in this state, the embroidery cannot be formed on a proper position. According to the above-described construction, however, the front-to-back position of the guide member can be adjusted by the position adjusting mechanism. Even when the rotating frame is inclined, the inclination of the rotating frame can be corrected such that the rotating frame is rotated about the horizontal axis extending front-to-back.

BRIEF DESCRIPTION OF THE DRAWINGS

Other objects, features and advantages of the present invention will become clear upon reviewing the following description of the preferred embodiment thereof, made with reference to the accompanying drawings, in which.

DETAILED DESCRIPTION OF THE PREFERRED EMBODIMENT

Figure 1:
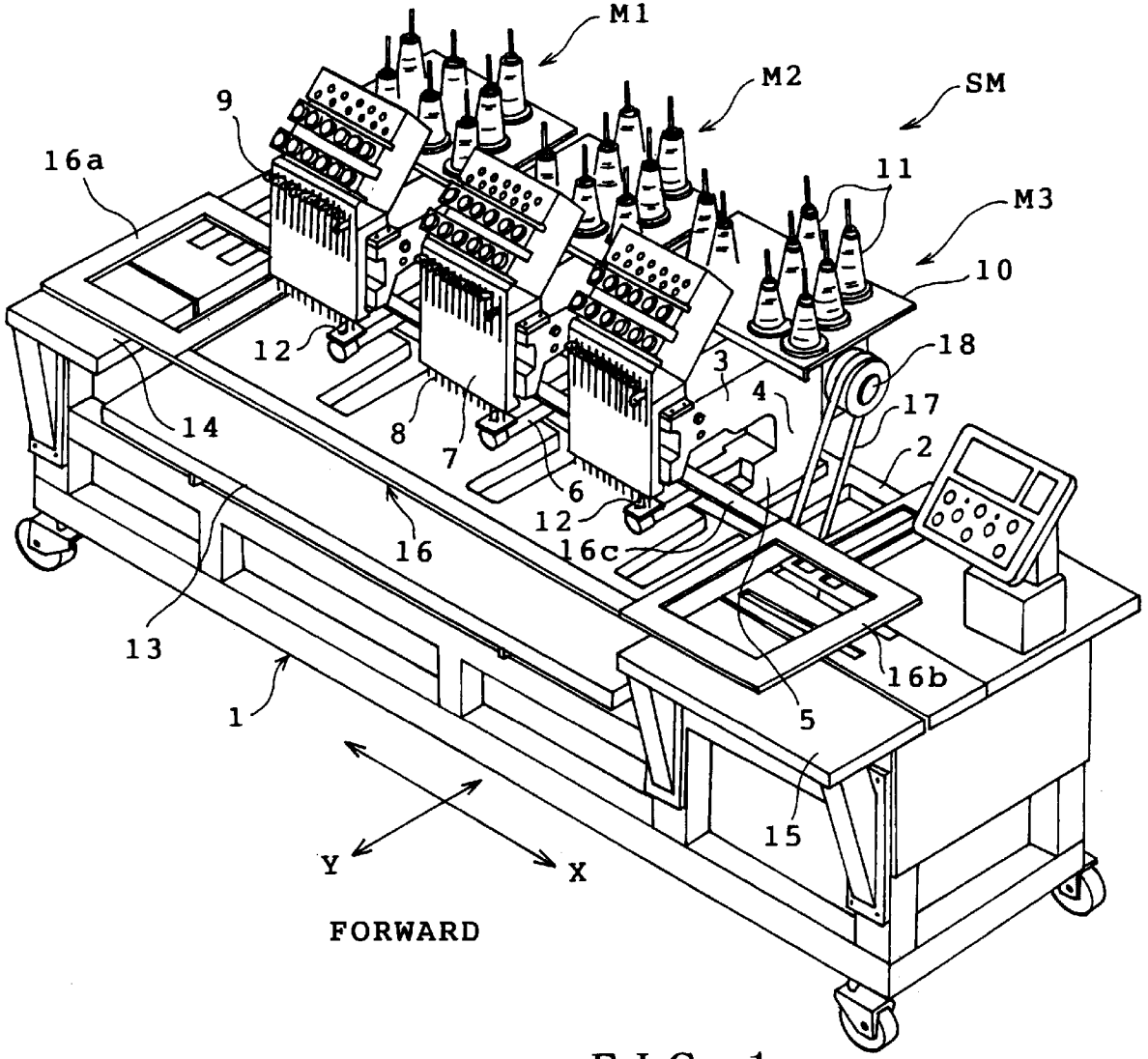
FIG. 1 is a perspective view of multi-head embroidering machine with which the headgear holder of one embodiment in accordance with the present invention is used.

One embodiment of the present invention will now be described with reference to the accompanying drawings. In the embodiment, the invention is applied to a headgear holder detachably attached to a multi-head embroidering machine. Referring to FIG. 1, the overall construction of the multi-head embroidering machine SM is shown. The multi-head embroidering machine SM comprises a base frame 1 extending in an X direction as shown in FIG. 1. A substantially rectangular machine support plate 2 mounted on an upper rear portion of the base frame 1 so as to extend in the x direction. A plurality of, for example, three multineedle embroidering machine units M1 to M3 are provided on the support plate 2 so as to be arranged in the X direction. The embroidering machine units M1–M3 have the same construction.

Each of the embroidering machine units M1–M3 comprises a machine body including an sewing-head arm 3, an arm support 4 extending downward from the rear of the sewing-head arm 3, and a head base 5 extending forward from a lower portion of the arm support 4 and fixed to the support plate 2. A needle bar case 7 is mounted on a front end of the sewing-head arm 3 for movement in the X direction. The needle bar case 7 supports thereon twelve needle bars (not shown) and twelve thread take-up levers 9 for vertical movement. Sewing needles 8 are secured to lower ends of the needle bars respectively. A sewing-bed arm 6 extends forward from a front end of the head base 5. The sewing-bed arm 6 is provided with a thread loop catcher and the like at a distal or front end thereof. A drive shaft 18 is connected via a V-belt 17 to a main motor (not shown). The needle bars and the thread take-up levers 9 are driven by an upper shaft (not shown), whereas the thread loop catcher is driven by a lower shaft (not shown) The upper and lower shafts are driven by the drive shaft 18.

Three spool holder bases 10 are provided in the rear of the needle bar cases 7 respectively. Twelve spool holder pins 11 are fixed to each spool holder base 10, so that twelve color-different threads are supplied from the spool holder pins 11 to the sewing needles 8 respectively. The needle bar case 7 is moved in the X direction so that one of the sewing needles 8 (needle bars) is disposed over a sewing position corresponding to the needle hole 12 at the distal end of the sewing-bed arm 6. As a result, only the needle bar and the thread take-up lever 9 connected to the needle bar are allowed to be moved vertically, whereby embroidery stitches are formed with a selected color of thread by cooperation of the needle 8 and the thread loop catcher.

A working table 13 movable upward and downward is provided in front of the support plate 2. The working table 13 is moved up to a position level with the upper surface of the sewing-bed arm 6. A pair of side tables 14 and 15 are provided at right-hand and left-hand sides of the working table 13. A rectangular moving frame 16 extends over the side tables 14 and 15 in the X direction. The moving frame 16 includes two drive frame portions 16*a* and 16*b* located at right-hand and left-hand ends thereof and a pair of front and rear X-direction frame portions 16*c* extending over the drive frame portions 16*a* and 16*b* which are disposed on the side tables 14 and 15 respectively. The right-hand drive frame portion 16*b* is moved in the X direction by an X-direction driving mechanism (not shown). Both of the drive frame portions 16*a* and 16*b* are moved in the Y direction by a Y-direction driving mechanism (not shown).

A headgear holder 20 mounted on each of the embroidering machine units M1 to M3 will now be described with reference to FIGS. 2 to 12. As shown in FIGS. 2 to 6, the headgear holder 20 comprises a guide shaft 21 secured to the bed 5 and extending forward along the sewing-bed arm 6, a base frame 22 supported on the guide shaft 21 so as to be moved frontward and backward, an annular rotating frame 23 to which a headgear holding member 100 is detachably attached, and a supporting mechanism 24 for supporting and guiding the rotating frame 23 for rotation about an axis parallel to the guide shaft 21 relative to the base frame 22. The headgear holder 20 further comprises a connecting mechanism 25 for connecting the base frame 22 to the moving frame 16, a rotating mechanism 26 for converting the rightward and leftward movement of the moving frame 16 to the rotation of the rotating frame 23, and a headgear supporting mechanism 27 for supporting the inside of a cap C attached to the headgear holding member in the vicinity of the sewing-bed arm 6.

Figure 4:
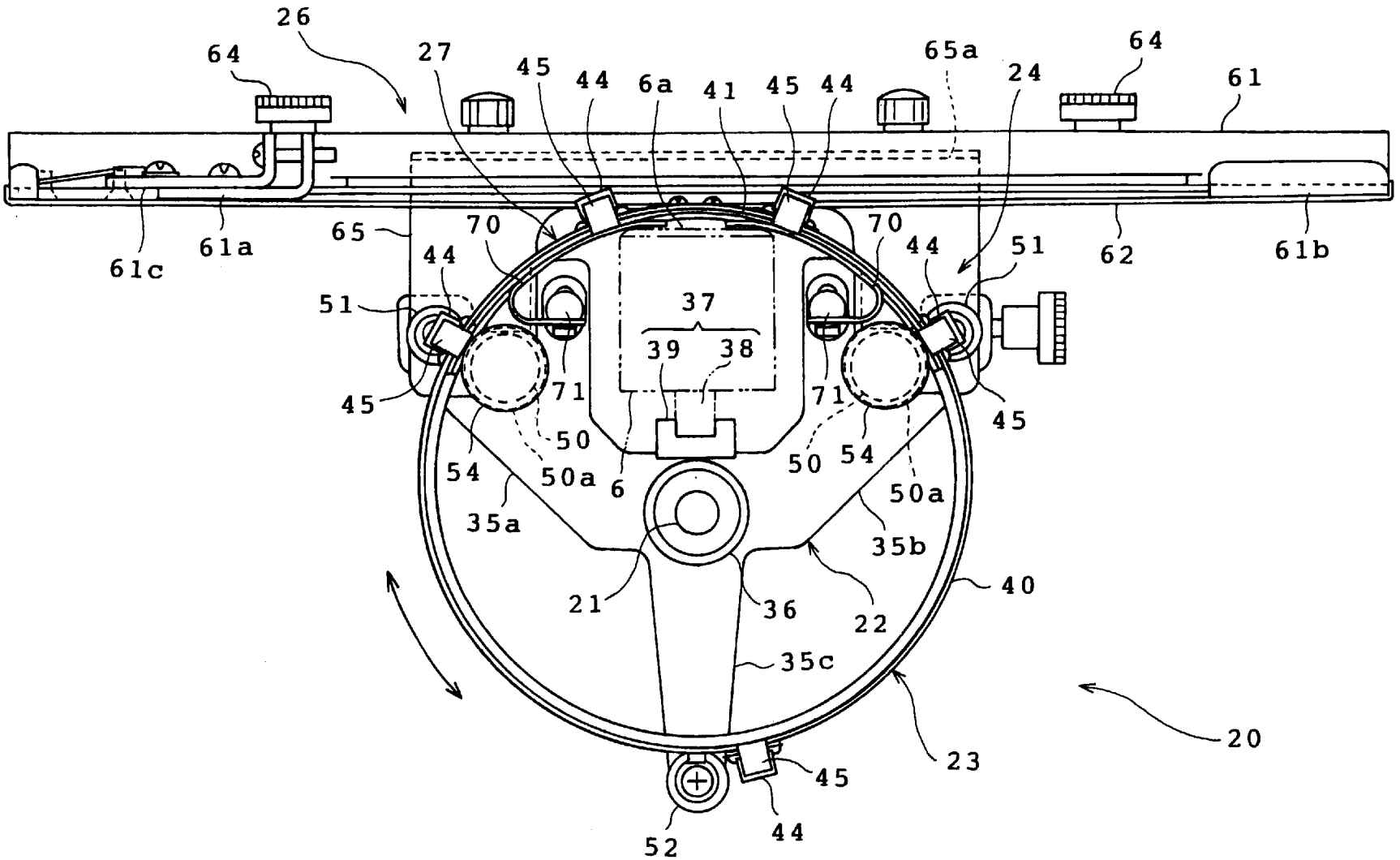
FIG. 4 is a front view of the headgear holder.
Figure 6:
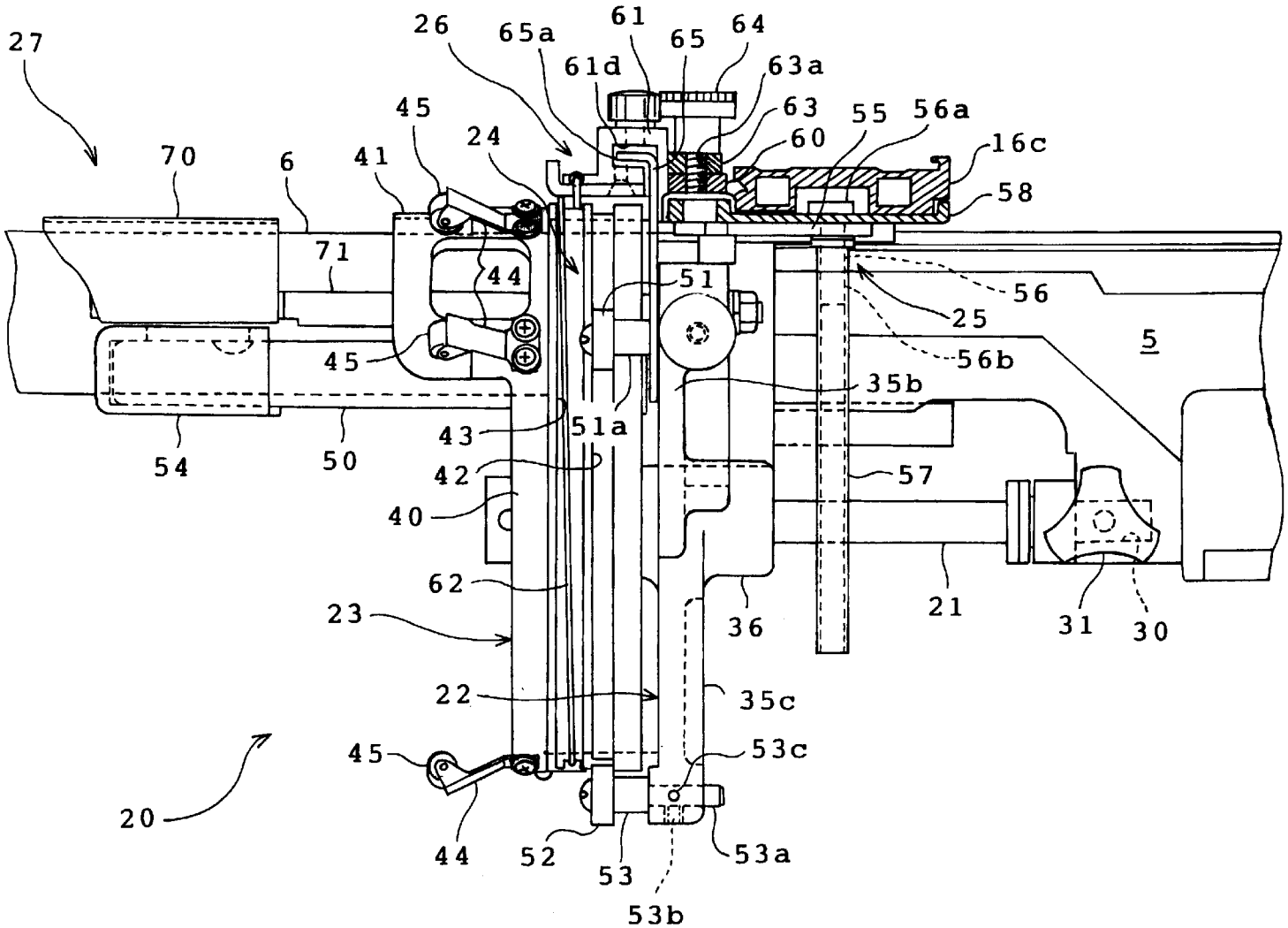
FIG. 6 is a right-hand side view of the headgear holder.

An insertion hole 30 is formed in the front of the bed 5 so as to be located below the proximal end of the sewing-bed arm 6, as shown in FIG. 6. The hole 30 extends horizontally front-to-back. A rear end of the guide shaft 21 is inserted into the hole 30 from the front to be fixed by a suitable fixture 31. The guide shaft 21 is thus detachably fixed to the bed 5. The base frame 22 includes substantially Y-shaped arms 35*a*, 35*b* and 35*c*, and a centrally located boss 36 as shown in FIG. 4. The boss 36 is fitted with the guide shaft 21 so as to be slid front-to-back. A rotation limiting mechanism 37 is provided for limiting rotation of the base frame 22. The rotation limiting mechanism 37 includes a keying member 38 fixed to the backside of the sewing-bed arm 6 and extending front-to-back, and a grooved member 39 secured to an upper portion of the boss 36 and engaging a lower portion of the keying member 38 so as to be slid front-to-back. As the result of the above-described construction, the base frame 22 is moved only front-to-back along the guide shaft 21 without rotation.

Figure 2:
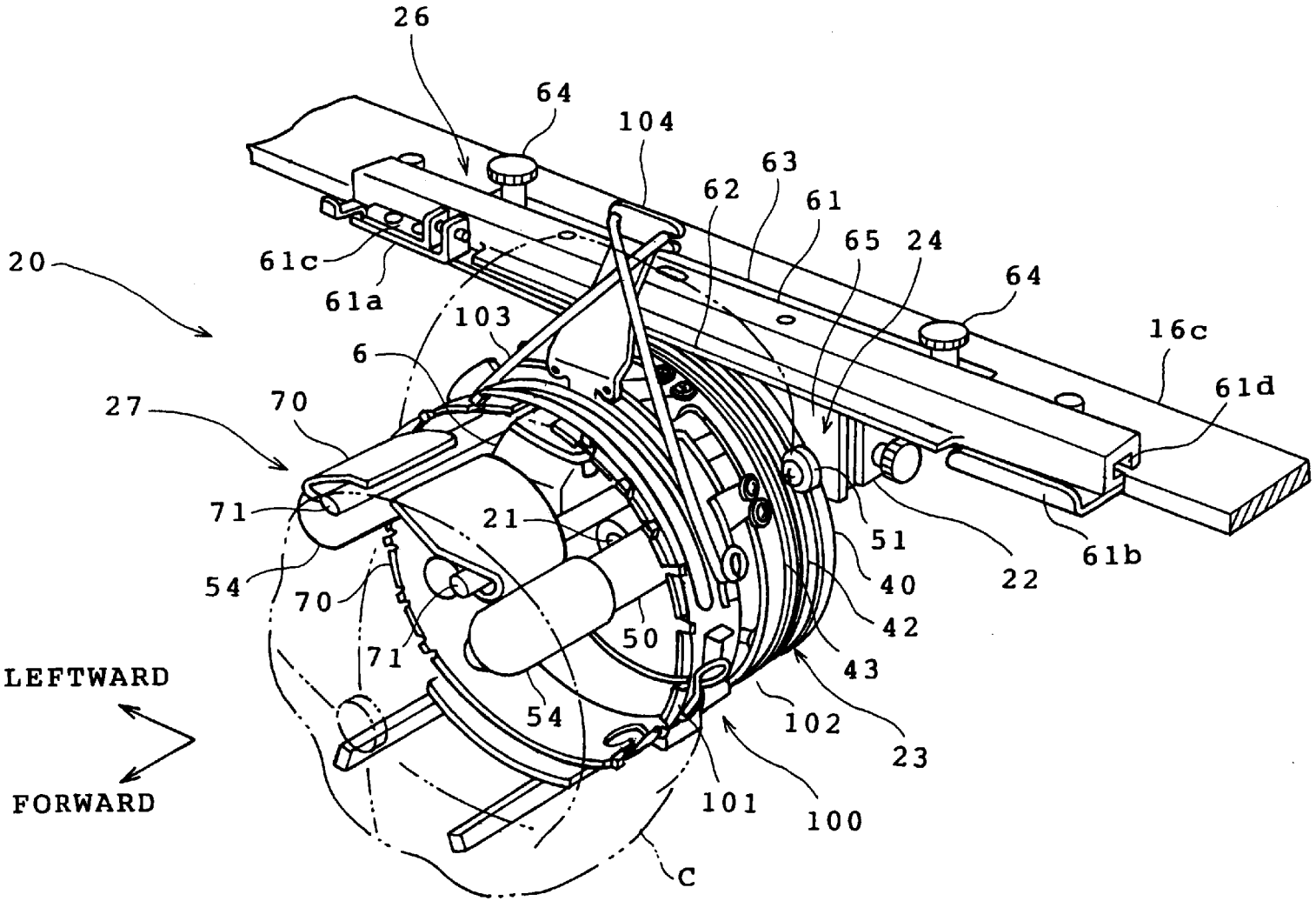
FIG. 2 is a perspective view of the headgear holder mounted on a moving frame of the embroidering machine as viewed from the upper right-hand side.

The rotating frame 23 includes an annular portion 40 and an arcuate headgear holder support 41 extending forward from an upper half of the annular portion 40, as shown in FIGS. 3 to 6. The annular portion 40 has a guide groove 42 serving as an engaged portion and a wire guide groove 43 each formed all around its outer periphery. For example, five elastically deforming members 44 have proximal ends screwed to a front end of the outer periphery of the annular portion 40. Engaging rollers 45 are detachably attached to distal ends of the elastically deforming members 44 for rotation respectively. The headgear holding member 100 is mounted on the headgear holder support 41 as shown in FIG. 2. The engaging roller 45 engages an engagement hole (not shown) of the headgear holding member 100 attached to the headgear holder support 41, thereby holding the headgear holder support 100 together with the rotating frame 23.

The supporting mechanism 24 includes two pairs of guide rollers 50 and 51 provided on the arms 35*a* and 35*b* of the base frame 22 so as to be opposed to each other with the rotating frame 23 being interposed therebetweeen, and a lower guide roller 52 provided on the lower sewing-head arm 35*c* of the base frame 22. The guide rollers 51 and 52 constitute a guiding member in the invention.

The guide roller 50 extends forward from the arms 35*a* and 35*b* and rolls on the inside of the annular portion 40 of the rotating frame 23. The guide roller 50 is made of a synthetic resin and has a rear end to which an annular rubber member 50*a* shown only in FIG. 4 is attached. Provision of the rubber member 50*a* allows the guide roller 50 to roll on the inside of the annular portion 40 without the guide roller 50 slipping. The guide rollers 51 and 52 engage a guide groove 42 formed in the outer circumference of the annular portion 40. As the result of the above-described construction, the rotating frame 23 is supported on the base frame 22 for rotation.

A split roller 54 is detachably mounted on a front end of the guide roller 50. When the rotating frame 23 is rotated during the embroidering operation, the split roller 54 is rotated with the guide roller 50, thereby being rolled on the inner circumference of the cap C without slipping to retain tension of the cap C.

Figure 10:
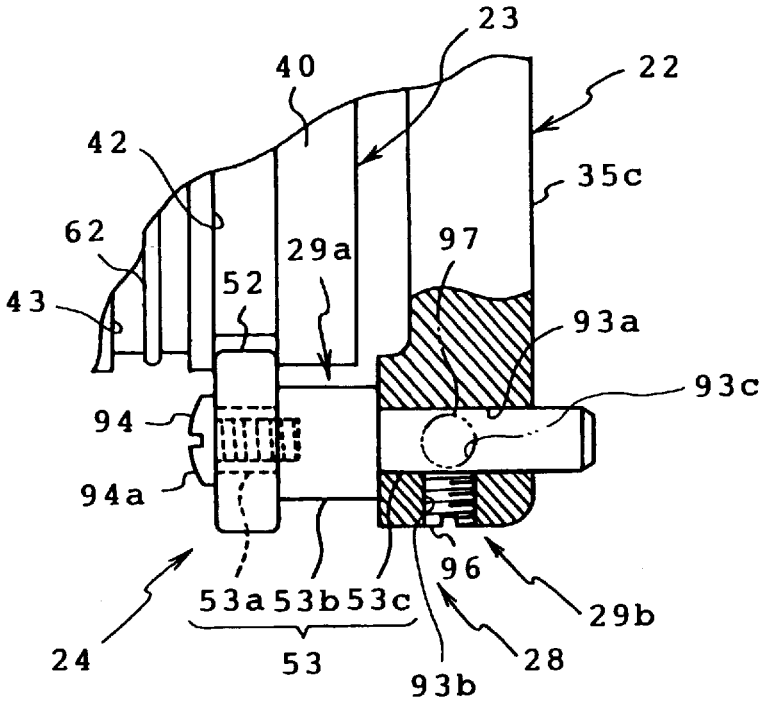
FIG. 10 is a partially sectional right-hand side view of a supporting mechanism for a rotating frame.
Figure 11:
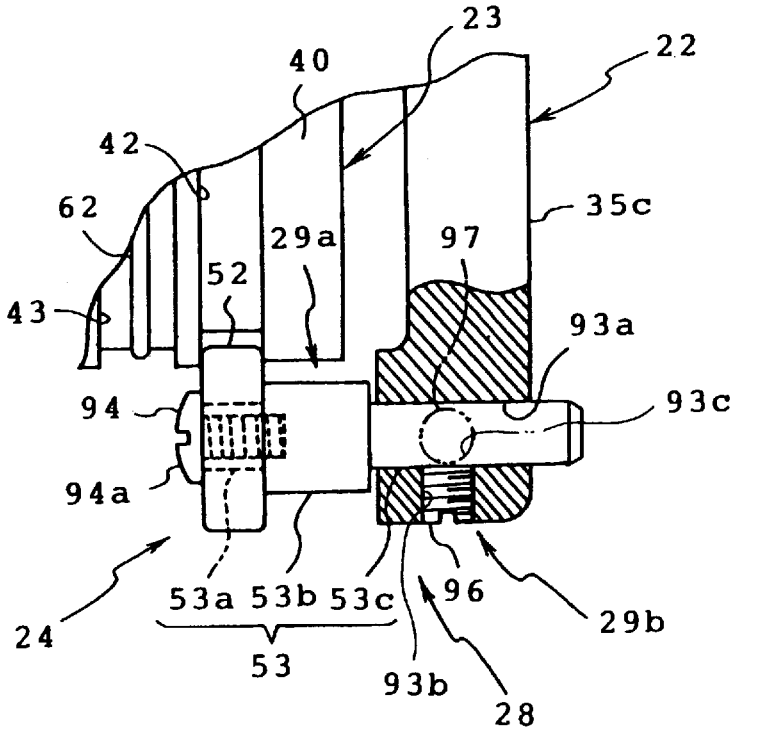
FIG. 11 is also a partially sectional right-hand side view of the supporting mechanism, showing a stepped pin thereof assuming a forward position.

The paired guide rollers 51 engaging a portion of the guide groove 42 located at an upper half of the rotating frame 23 are supported on front ends of stepped pins 51*a* fixed via a connecting plate 65 to the arms 35*a* and 35*b* of the base frame 22, respectively, as shown in FIG. 6. The connecting plate 65 is formed into the shape of a gate or a C-shape On the other hand, the guide roller 52 engaging a portion of the guide groove 42 located at a lower half of the rotating frame 23 is supported on a front end of a stepped pin 53 fixed to the arm 35*c* of the base frame 22 for rotation, as shown in FIGS. 10 and 11. The stepped pin 53 includes a small-diameter shaft portion 53*a*, a large-diameter shaft portion 53*b*, an inserted shaft portion 53*c* in the order from its front end. The large-diameter portion 53*b* has a diameter larger than the small-diameter portion 53*a* and the inserted shaft portion 53*b*. The guide roller 52 is fitted in the small-diameter shaft portion 53*a* and then fastened to the stepped pin 53 by a bolt 94, so that the guide roller 52 is supported for rotation between a head 94*a* of the bolt 94 and a front end of the large-diameter shaft portion 53*b*. The guide roller 52 is rotated with some idling.

The arm 35*c* has in a lower end thereof an insertion hole 93*a* extending front-to-back, a screw hole 93*b* extending downward from the insertion hole 93*a* and a screw hole 93*c* extending rightward from the insertion hole 93*a*. The inserted shaft portion 53*c* of the stepped pin 53 is extends through the insertion hole 93*a*. Two set or locking screws 96 and 97 are screwed into the screw holes 93*b* and 93*c* respectively such that the distal ends of the screws 96 and 97 are pressed against the inserted shaft portion 53*c*. As a result, the stepped pin 53 is fixed to the base frame 22. When the set screws 96 and 97 are loosened, the inserted shaft portion 53*c* is slidable in the insertion hole 93*a*, so that the stepped pin 53 is moved front-to-back. Accordingly, the stepped pin 53 serves as a supporting mechanism 29*a* for supporting the guide roller 52 so that the front-to-back position of the roller 52 is adjusted relative to the base frame 22 in the invention. The set screws 96 and 97 serve as a fixing mechanism 29*b* for releasably fixing the guide roller 52 to the base frame 22 in the invention. The supporting mechanism 29*a* and the fixing mechanism 29*b* constitute a position adjusting mechanism 28.

The connecting mechanism 25 includes a connecting member 55 fixed to the arm 35*b* of the base frame 22, a flanged shaft 56 inserted into the connecting member 55, and an operation lever 57 rotatably mounted on a shaft portion 56*b* of the flanged shaft 56 located below the connecting member 55, as shown in FIG. 6. A Y-direction feeding member 58 is fixed to the backside of the moving frame 16. The Y-direction feeding member 58 has a hole (not shown) through which the flanged shaft 56 is inserted. The hole includes a circular hole portion through which a flange 56*a* of the flanged shaft 56 is allowed to pass and an elongate hole portion through which the shaft portion 56*b* of the flanged shaft, 56 is allowed to pass but through which the flange 56*a* thereof is disallowed to pass. When the flanged shaft 56 is inserted through the circular hole portion into the elongate hole portion, the operation lever 57 is rotated so that the flanged shaft 56; is moved downward. The Y-direction feeding member 58 is held between the flange 56*a* and the connecting member 55, whereby the base frame 22 is connected to the Y-direction feeding member 58. Consequently, the base frame 22 is moved fore and aft together with the moving frame 16.

Referring to FIGS. 2 to 6, the rotating mechanism 26 includes a mounting plate 60 detachably attached to a rear or X-direction. frame portion 16*c* of the moving frame 16, a moving member 61 connected to the mounting plate 60 so that a front-to-back position of the moving member 61 is adjustable, and a wire 62 wound along the wire guide groove 43 on the rotating frame 23 and having both ends connected to opposite ends of the moving member 61 respectively. The mounting plate 60 is formed into an elongate shape and has left-hand and right-hand ends formed with connecting holes 60*a* and 60*b* and 60*c* and 60*d* respectively. Thumbscrews (not shown) are inserted into the connecting hole 60*a* or 60*b* and the connecting hole 60*c* or 60*d* respectively to be engaged with the X-direction frame portion 16*c* while the backside of the mounting plate 60 is in abutment with the upper front end of the X-direction frame portion 16*c*, whereby the mounting plate 60 is fastened to the X-direction frame portion. 16*c*.

Figure 3:
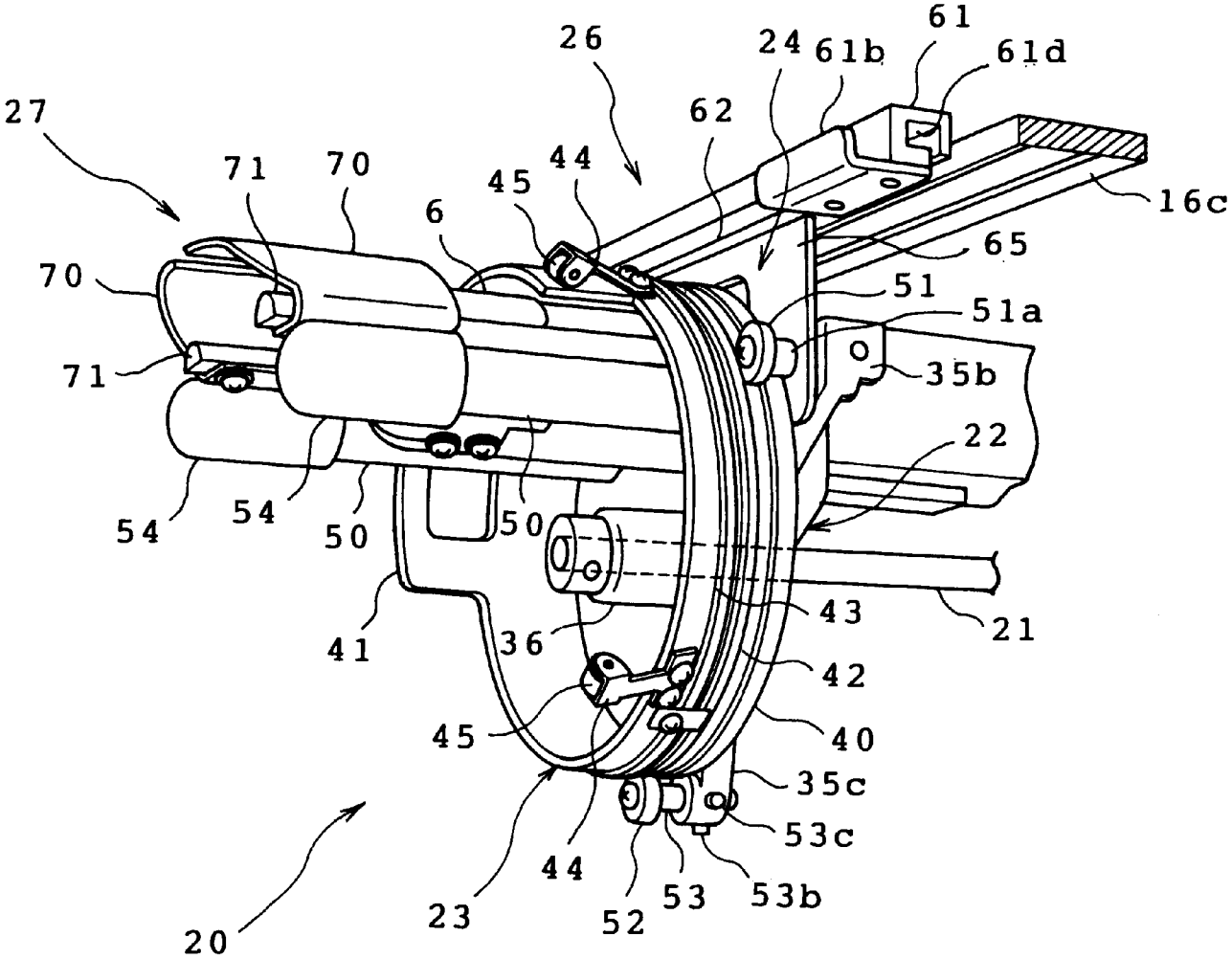
FIG. 3 is a perspective view of the headgear holder with a headgear holding member being eliminated as viewed from the lower right-hand side.

The moving member 61 is formed into an elongate shape and has on its rear a connecting plate 63 formed integrally therewith. The connecting plate 63 has opposite ends formed with elongate holes 63*a* respectively. Thumbscrews 64 are inserted into the respective elongate holes 63*a* to be engaged with the connecting plate 63 while the backside of the connecting plate 63 is in abutment with an upper face of the mounting plate 60, whereby the moving member 61 is fastened to the mounting plate 60. Further, the moving member 61 has a pair of metal plates 61*a* and 61*b* fixed to opposite ends thereof respectively so as to project forward. A mounting piece 61*c* is fixed to an upper face of the left-hand metal plate 61*a* so that the position thereof is adjustable leftward and rightward. The wire 62 extending leftward from the rotating frame 23 is folded back at a left-hand end of the metal plate 61*a* and thereafter, its end is fixed to an upper face of the mounting piece 61*c* by a screw. On the other hand, the wire 62 extending rightward from the rotating frame 23 is folded back at a right-hand end of the metal plate 61*b* and thereafter, its end is fixed to an upper face of the metal plate 61*b* by a screw. As the result of the above-described construction, when the moving member 61 is moved rightward or leftward together with the moving frame 16, both ends of the wire 62 are pulled such that the rotating frame on which the wire 62 is wound is rotated. The moving member 61 has an engagement hole 61*d* formed therein so as to extend over its entire length and be open downward, as shown in FIGS. 3 and 6. An upper end bent portion 65*a* of the connecting plate 65 engages the hole 61*d* of the moving member 61 so as to be movable rightward or leftward.

The headgear supporting mechanism 27 will now be described with reference to FIGS. 2 to 7. The headgear supporting mechanism 27 includes a pair of support bars 71 connected to the arms 35*a* and 35*b* of the base frame 22 respectively and a pair of headgear support plates 72 connected to front ends of the support bars 71 respectively. The headgear support plates 70 are disposed in front of the rotating frame 23 to support the inside of the cap C attached to the headgear holding member 100, as shown in FIG. 2. The headgear support plates 70 are symmetrically disposed on the respective support bars 71 so as to extend rightward and leftward over the sewing-bed arm 6. A space which is approximately the same as the needle hole 6*a* of the sewing-bed arm 6 is defined between ends of the headgear support plates 70 opposite each other.

Figure 5:
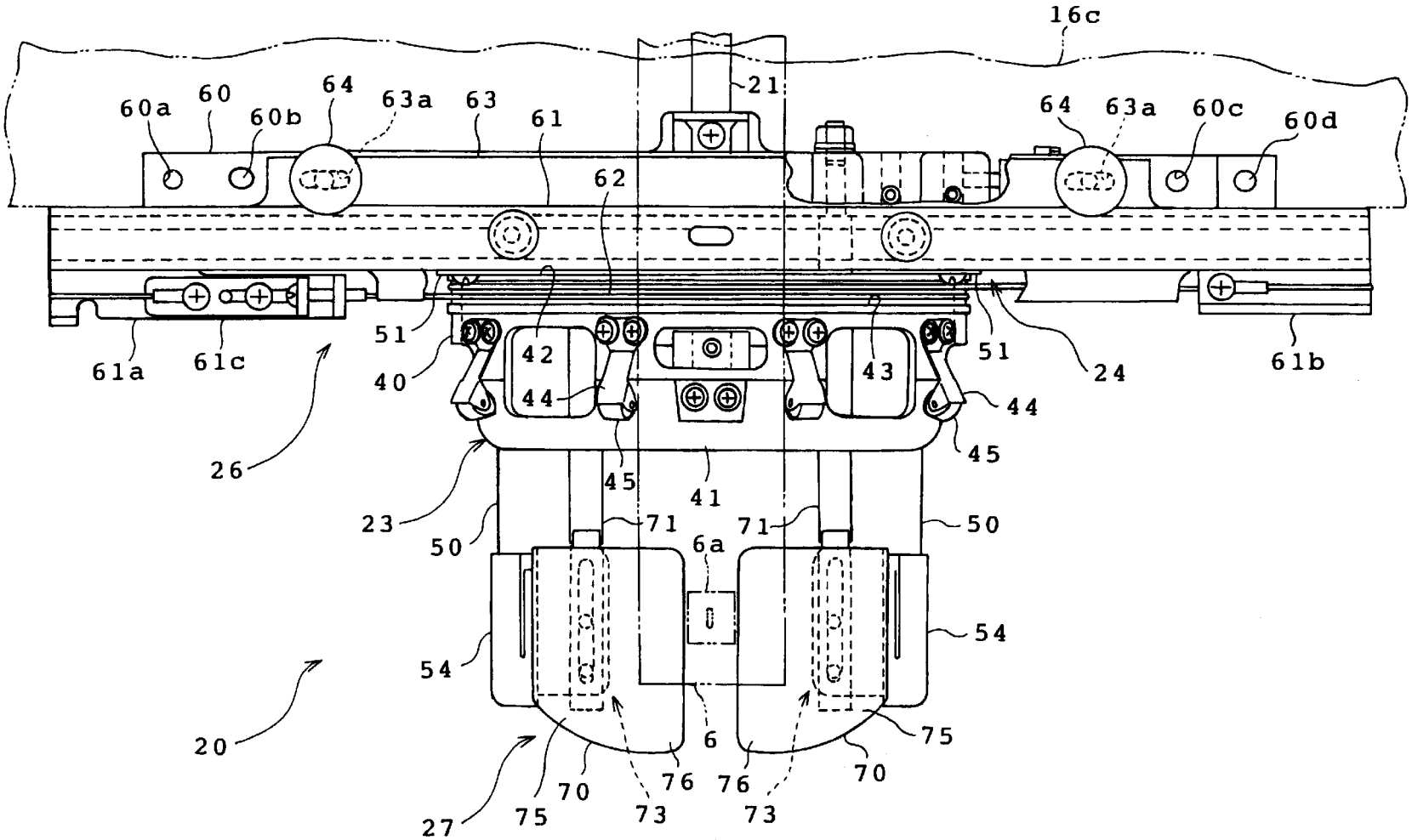
FIG. 5 is a top plan view of the headgear holder.

Each headgear support plate 70 includes a cylindrical portion 75 formed into an arcuate shape having approximately the same curvature as the headgear holder support portion 41 of the rotating frame 23, as shown in FIG. 5. Each headgear support plate 70 further includes an upper horizontal portion 76 continuous to an upper end of the cylindrical portion 75 and opposed to the upper face of the sewing-bed arm 6 and a lower horizontal portion 77 (see FIG. 7) extending from a lower end of the cylindrical portion 75 toward the side of the sewing-bed arm 6. The cylindrical portions 75 support the inner periphery of the cap C projecting ahead of the headgear holder support portion 41 (namely, the headgear holding member 100 ) of the rotating frame 23 at portions of the cap located at right-hand and left-hand sides of the needle hole 6*a*.

Figure 7:
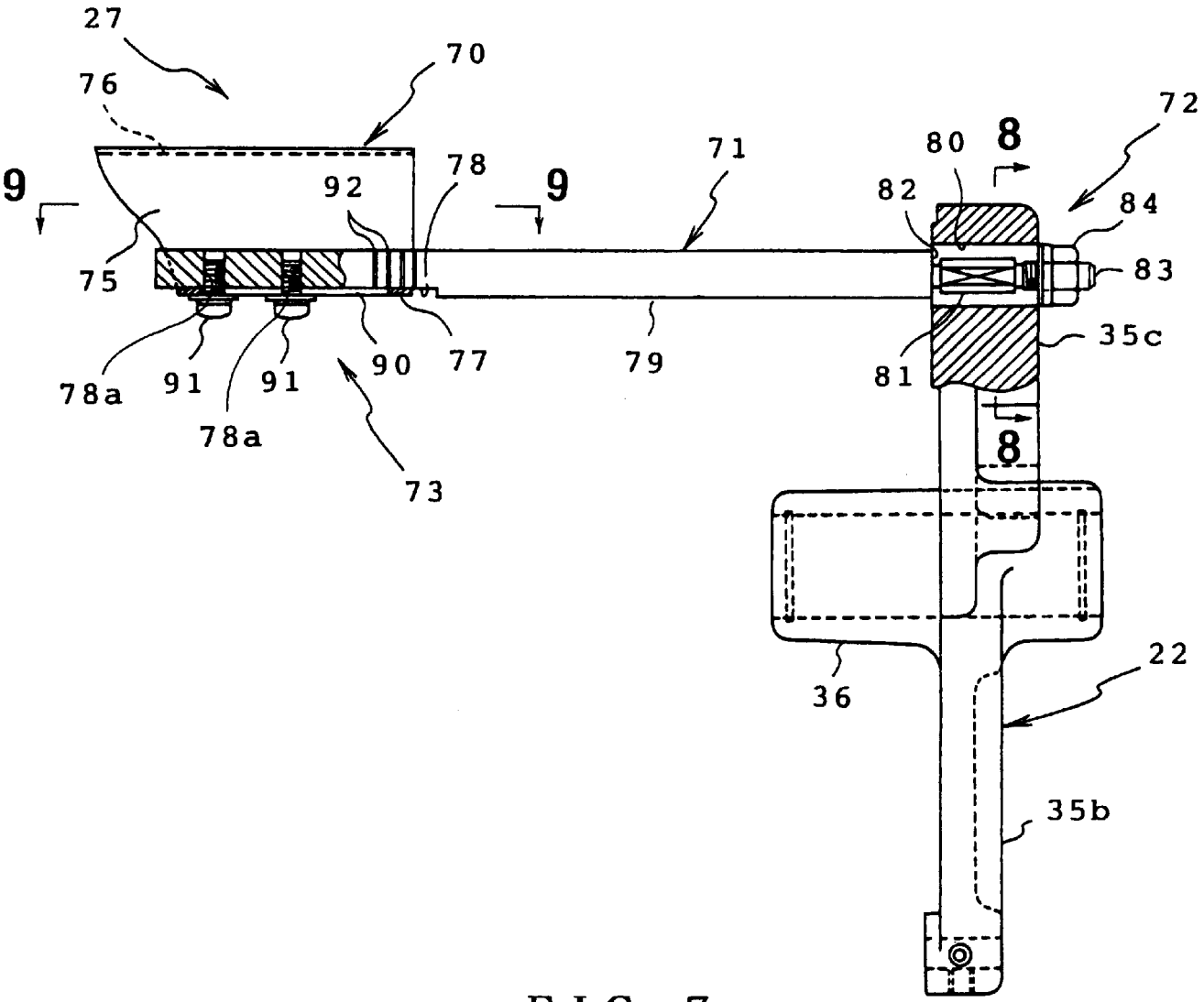
FIG. 7 is a right-hand side view of a vertical position adjusting connecting mechanism, a for-and-aft position adjusting connecting mechanism and a headgear supporting mechanism of the headgear holder.
Figure 8:
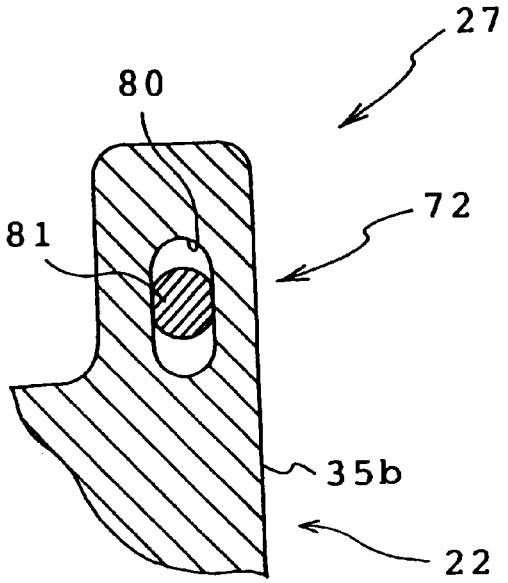
FIG. 8 is a sectional view taken along line 8—8 in FIG. 7.
Figure 9:
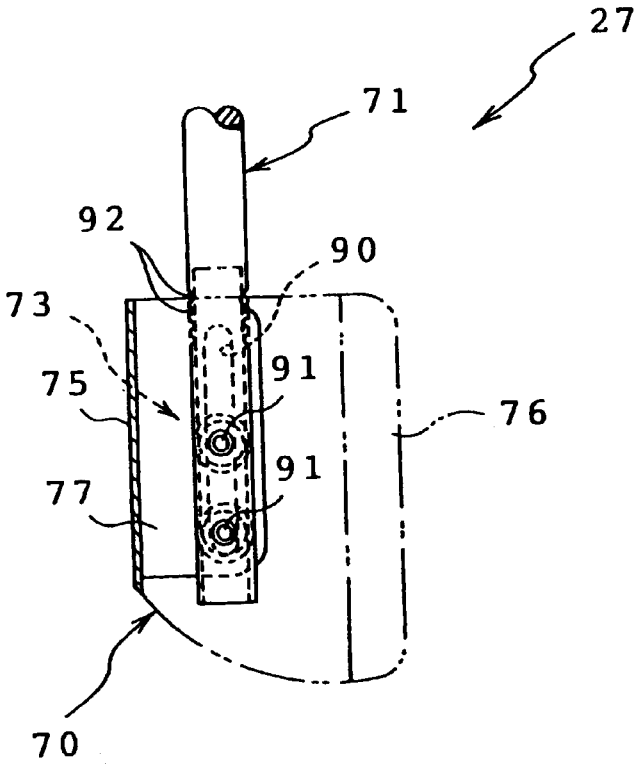
FIG. 9 is a sectional view taken along line 9—9 in FIG. 7.

Each support bar 71 includes a shaft body 79 having a substantially circular section and an abutting face 78 formed on the lower front end thereof as shown in FIG. 7. The abutting face 78 has a pair of lengthwise spaced screw holes 78*a*. Further, each support bar 71 has in a rear end thereof an insertion shaft portion 81 having a smaller diameter than the shaft body 79 and a threaded portion 83. The insertion shaft portion 81 has a substantially oval section as shown in FIG. 8. As the result of the insertion shaft portion 81 having the smaller diameter than the shaft body 79, an abutment portion 82 is formed on the rear face of the shaft body 79 so as to be perpendicular thereto.

The arms 35*a* and 35*b* of the base frame 22 are formed with vertically long elongate holes 80 respectively as shown in FIGS. 7 and 8 in which only the arm 35*b* is shown. The insertion shaft portion 81 of each support bar 71 is inserted into the elongate hole 80. The elongate hole 80 has approximately the same width as the insertion shaft portion 81. Accordingly, the insertion shaft portion 81 is disallowed to rotate in the elongate hole 80. A nut 84 is screwed onto the threaded portion 83 projecting in the rear of the base frame 22. Consequently, the base frame 22 is held between the abutment portion 82 and the nut 84, so that the support bar 71 is fixed to the base frame 22 in the horizontal state.

When the nut 84 is loosened, the insertion shaft portion 81 is permitted to move upward and downward in the elongate hole 80, so that the vertical position of the support bar 71 can be adjusted. Accordingly, the hole 80, the insertion shaft portion 81, the abutment portion 82 and the threaded portion 83 of each support bar 71, and the nut 84 constitute a vertical position adjustment connecting mechanism 72 for connecting each headgear support plate 70 to the base frame 22 so that the position of each plate 70 is adjustable upward and downward.

Each headgear support plate 70 is connected to the corresponding support bar 71 in the following manner. The lower horizontal portion 77 of the headgear support plate 70 has an elongate hole 90 extending lengthwise with respect thereto The abutment face 78 of each support bar 71 is in abutment with the upper face of the lower horizontal portion 77. A pair of bolts 91 are screwed through the elongate holes 90 into a pair of bolt holes 78*a* from below the lower horizontal portion 77, respectively, so that each headgear support plate 70 is fixed to the corresponding support bar 71. Further, when the bolts 90 are loosened, each headgear support plate 70 can be moved forward and backward along the elongate holes 90, whereby the front-to-back position of each headgear support plate 70 can be adjusted relative to the corresponding support bar 71. As shown in FIG. 7, each support bar 71 has a plurality of, for example, four, baselines 92 formed at regular intervals on the front end thereof. When the operator align the rear end of each headgear support plate 70 and any base line 92, the front-to-back position of each headgear support plate 70 can be adjusted. Accordingly, the support bar 71, bolt hole 78*a*, the elongate holes 90 and the bolts 91 constitute a front-to-back position adjustment connecting mechanism 73 for connecting each headgear support plate 70 to the base frame 22 so that the front-to-back position of the plate 70 is adjustable.

The headgear holding member 100 will now be described briefly with reference to FIG. 2. The headgear holding member 100 includes a curved body 101 detachably attached to the rotating frame 23, a presser frame 102 detachably attached to the body 101 for fixing the cap C from outside, and a peak receiving member 104 for receiving a peak of the cap C fixed to the body 101. The peak of the cap C received by the peak receiving member 104 is fixed by a cord 103. Various types of headgear holding members 100 are attached to the rotating frame 23 according to the sizes and shapes of the caps. The split roller 54 is attached to or detached from the guide roller 50 depending upon the structure of the headgear holding member 100 so that the member 100 and the split roller 54 do not interfere with each other.

The operation of the headgear holder will now be described with reference to FIGS. 7 to 12. When an embroidery is to be sewn on the cap C with the above-described multi-head embroidering machine SM, the position of each headgear support plate 70 of the headgear holder 20 is adjusted according to the size, shape, etc. of the cap. More specifically, when the vertical position of each headgear support plate 70 is to be adjusted, the nut 84 is loosened so that the insertion shaft portion 71 of the support bar 70 is moved to a suitable position within the elongate hole 80. The nut 84 is then re-fastened tight so that the support bar 71 is fixed to the base frame 22.

Further, when the front-to-back position of each headgear support plate 70 is to be adjusted, the bolts 91 are loosened so that each headgear support plate 70 is moved to a suitable position at the front end of the support bar 71. Thereafter, the bolts 91 are re-fastened tight so that each headgear support plate 70 is fixed to the front end of the support bar 71.

The paired headgear support plates 70 are discrete from each other and are connected to the respective support bars 71. Accordingly, the positions of the headgear support plates 70 can be adjusted independently of each other. Consequently, each headgear support plate 70 can accurately be disposed so as to assume a proper vertical position and front-to-back position even when there is an error between the dimensions of the headgear support plates 70. Further, the positions of each headgear support plate 70 can easily be adjusted fine since each headgear support plate 70 is easily moved upward and downward, and forward and backward. Consequently, each headgear support plate 70 and the sewing-bed arm 6 can be prevented from interfering with each other, and a high quality of the embroidery can reliably be ensured.

Further, each vertical position adjustment connecting mechanism 72 has a simple construction. More specifically, in each connecting mechanism 72, the base frame 22 is formed with the elongate hole 80 into which the insertion shaft portion 81 of the support bar 71 is inserted. The nut 84 is then engaged with the screw portion 83. Additionally, each front-to-back position adjustment connecting mechanism 73 also has a simple construction. More specifically, the headgear support plate 70 is formed with the elongate holes 90 and the support bar 71 is formed with the bolt holes 78 a with which the respective bolts 91 are engaged while each headgear support plate 70 is in abutment with the abutment face 78 of the support bar 71. Consequently, the manufacturing cost of the headgear holder can be reduced.

Each of the base frame 22 and the rotating frame 23 has a large weight. When the headgear holder 20 is attached to the multi-head embroidering machine SM, the self-weight of each of the base frame 22 and the rotating frame 23 causes the guide shaft 21 to incline downward, whereupon the base frame 22 and the rotating frame 23 are sometimes inclined. In this case, the pair of set screws 96 and 97 are first loosened so that the stepped pin 53 is released from the fixed state. Thereafter, the stepped pin 53 is moved forward a predetermined distance according to an inclination of the base frame 22 as shown in FIG. 11. The set screws 96 and 97 are then re-fastened tight so that the stepped pin 53 is fixed to the base frame 22. Consequently, the lower end of the rotating frame 23 in engagement with the guide groove 42 of the guide roller 52 is moved forward, whereby the inclination of the rotating frame 23 is corrected. Accordingly, the rotating frame 23 can be rotated about the horizontal axis extending fore and aft even when the guide shaft 21 is inclined downward.

In the case where the center of rotation of the rotating frame 23 deviates from the horizontal axis, an embroidery sewn on the cap C is shifted from an intended position. In the foregoing embodiment, however, the front-to-back position of the guide roller 52 is adjustable such that the inclination of the rotating frame 23 is corrected. Consequently, the shifting of the embroidery sewn on the cap C can be prevented and accordingly, a reduction in the sewing accuracy can be prevented.

Figure 12:
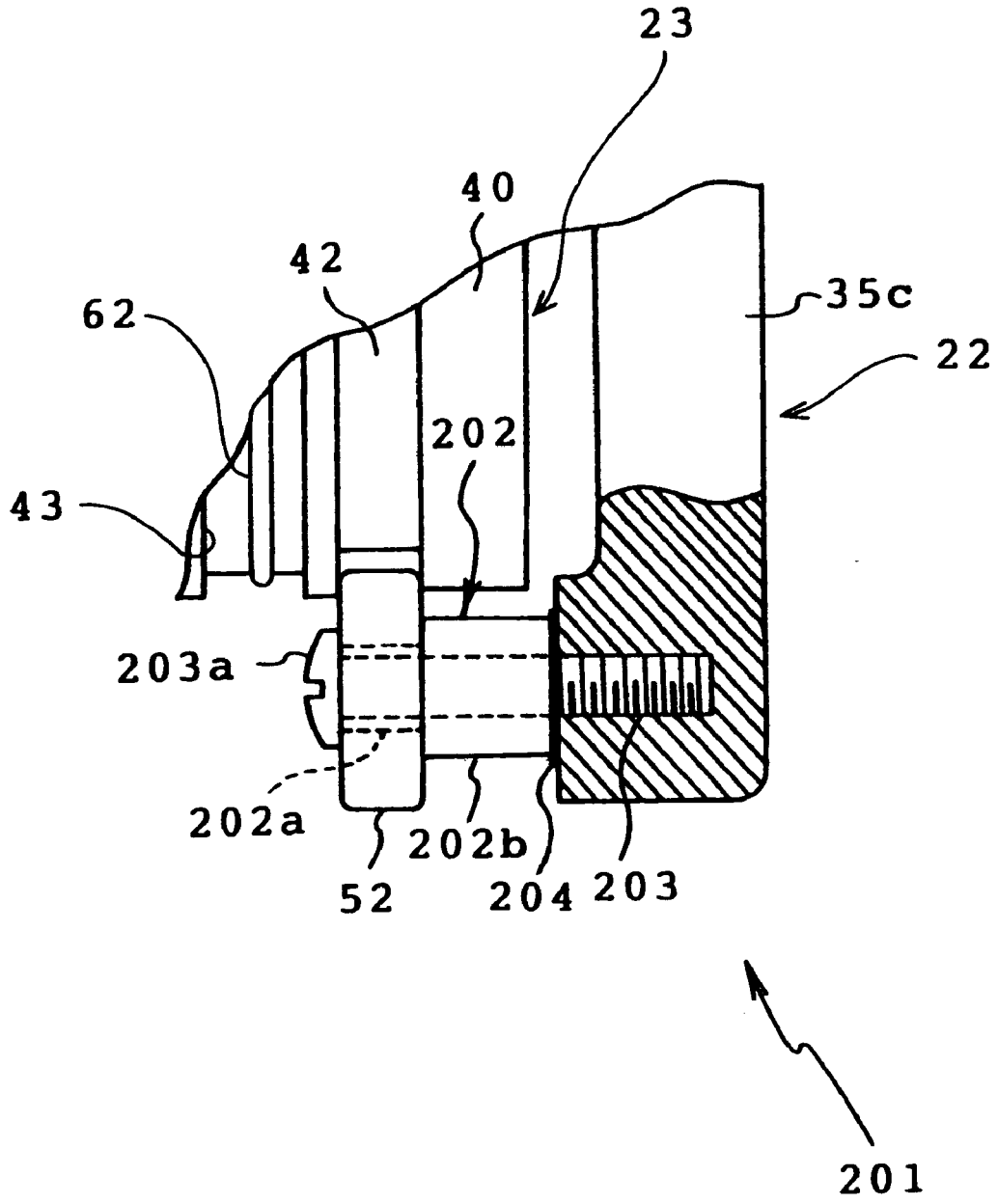
FIG. 12 PRIOR ART
FIG. 12 is a view similar to FIG. 10, showing a conventional supporting mechanism.

In a conventional headgear holder 201 in FIG. 12, a guide roller 52 is mounted on a base frame 22 in a manner as shown in FIG. 12. More specifically, the guide roller 52 is fitted with a small-diameter shaft portion 202*a* of a stepped pin 202 which includes a large-diameter shaft portion 202*b* as well as the small-diameter shaft portion 202*a*. The stepped pin 202 is fixed to the front of the base frame 22. As a result, the guide roller 52 is rotatably supported between a front end face of the large-diameter shaft portion 202*b* and a head 203*a* of the bolt 203. For example, when a guide shaft 21 is inclined downward such that a rotating frame 24 is inclined, one or more spacers 204 are placed between the stepped pin 202 and the base frame 22. As a result, the guide roller 52 is moved forward so that the inclination of the rotating frame 23 is corrected.

However, moving the guide roller 52 forward requires the following troublesome operation. That is, the bolt 203 fastening the stepped pin 202 tight is loosened so that the stepped pin 202 is moved forward, whereby a space equal to or larger than the thickness of the spacer 204 is defined between the base frame 22 and the stepped pin 202. The spacer 204 is then placed in the space and thereafter, the stepped pin 202 is moved backward so that the spacer 204 is held between the base frame 22 and the stepped pin 202. The bolt 203 is then fastened tight. Further, a distance of forward movement of the guide roller 52 depends upon the thickness of the spacer 204 and the number of the spacers to be placed between the base frame 22 and the stepped pin 202 Consequently, a fine adjustment of the movement distance of the guide roller 52 is difficult and accordingly, the inclination of the rotating frame 23 cannot completely be corrected.

On the other hand, the front-to-back position of the guide roller 52 can be adjusted by a simple operation in the foregoing embodiment. More specifically, the set screws 96 and 97 are loosened so that the stepped pin 53 is moved the predetermined distance according to the inclination of the base frame 22. Thereafter, the set screws 96 and 97 are re-fastened tight. Further, since the stepped pin 53 is moved any distance, the front-to-back position thereof can accurately be adjusted and furthermore, a fine adjustment can be achieved without using a spacer. When such a fine adjustment is achieved using the spacer 204, a number of spacers 204 having different thicknesses are required.

Further, the stepped pin 53 can be moved not only forward but also backward when fixed to the base frame 22 with a space being defined between the rear end of the large-diameter shaft portion 53*b* thereof and the base frame 22 (in the state shown in FIG. 11) in the normal state where the rotating frame 23 is not inclined.

The present invention should not be limited to the foregoing embodiment and may be modified as follows. Each headgear support plate 70 may be connected to the base frame 22 so that either the vertical position or the front-to-back position thereof is adjustable. In other words, either the vertical position adjustment connecting mechanism or the front-to-back position adjustment connecting mechanism may be eliminated.

Both of the vertical position adjustment connecting mechanism and or the front-to-back position adjustment connecting mechanism may be provided at the distal end of each support bar 71. More specifically, a connecting plate which can adjust the vertical position may be connected to the front end of each support bar 71 fixed to the base frame 22. Each headgear support plate 70 may be connected to the corresponding connecting plate so that the front-to-back position thereof can be adjusted.

The front-to-back position of the guide roller 52 engaging the guide groove 42 in the lower end of the rotating frame 23 is adjusted in the foregoing embodiment. However, the stepped pin 53 supporting the guide roller 52 may be fixed to the base frame, and the front-to-back positions of the stepped pins 51*a* supporting a pair of guide rollers 51 engaging the respective guide grooves 42 at the upper portion of the rotating frame 23 may be adjustable, instead. Further, the front-to-back positions of the three guide rollers 51 and 52 may be adjustable. In this case, the inclination of the rotating frame 23 can be corrected even when the rotating frame is inclined in any direction due to an error in the dimensions of the headgear holder 20 or an error resulting from the assembling of the headgear holder 20 onto the embroidering machine.

A convex engagement portion may be formed over the entire circumference of the rotating frame 23, instead of the guide groove 42. Further, guide rollers having respective grooves engageable with the convex engagement portion may be used, instead of the guide rollers 71 and 72. Additionally, guide rollers slidingly engageable with the guide groove 42 may be used, instead of the guide rollers 71 and 72.

A decentering mechanism may be incorporated in the supporting mechanism 29*a* of the position adjusting mechanism 28, so that a radial position of the guide roller 52 relative to the rotating frame 23, that is, a distance between the rotating frame 23 and the guide roller 52 can be adjusted by the decentering mechanism. In this construction, for example, the insertion shaft portion 53*c* and the small-diameter shaft portion 53*a* of the stepped pin 53 are decentered and the stepped pin 53 is rotated, whereby the radial position of the guide roller 52 relative to the rotating frame 23 can be adjusted.

The headgear holder of the present invention may be used with a single-head embroidering machine as well as the multi-head embroidering machine. Further, the invention may be applied to various types of headgear holders.

The foregoing description and drawings are merely illustrative of the principles of the present invention and are not to be construed in a limiting sense. Various changes and modifications will be apparent to those of ordinary skill in the art. All such changes and modifications will be seen to fall within the scope of the present invention defined by the appended claims.

I claim:

1. A headgear holder mounted on an embroidering machine including a body and a sewing-bed arm extending front-to-back with respect to the body so that an embroidery is sewn on a headgear, the headgear holder comprising:

a guide shaft secured to the body of the embroidering machine and extending along the sewing-bed arm;

a base frame supported on the guide shaft so as to be moved front-to-back;

an annular rotating frame supported on the base frame so as to be rotated;

a headgear holding member detachably attached to the rotating frame to hold the headgear; and a pair of headgear support plates provided ahead of the rotating frame so as to be spaced from each other right and left with respect to the rotating frame so that positions of the headgear support plates are vertically adjustable independently of each other.

2. A headgear holder according to claim 1, further comprising a pair of vertical position adjustment connecting mechanisms for connecting the headgear support plates so that the positions of the respective headgear support plates are vertically adjustable relative to the base frame.

3. A headgear holder according to claim 2, further comprising a pair of front-to-back position adjustment connecting mechanisms for connecting the headgear support plates so that front-to-back positions of the respective headgear support plates are adjustable relative to the base frame.

4. A headgear holder according to claim 3, wherein each vertical position adjustment connecting mechanism includes a support bar provided on the base frame so as to extend forward from a front of the base frame and having a front end to which the headgear support plate is connected, the base frame has vertically elongate holes, and each support bar has a rear end provided with an insertion shaft inserted into one of the elongate holes of the base frame so as to be vertically movable and non-rotatable.

5. A headgear holder according to claim 4, wherein the support bars have abutting portions abutting the front of the base frame when the insertion shafts have been inserted into the elongate holes of the base frame, respectively and screw portions protruding in the rear of a back of the base frame when the insertion shafts have been inserted into the elongate holes of the base frame, respectively, the vertical position adjustment connecting mechanisms include nuts engageable with the screw portions respectively, and the insertion shafts are inserted into the elongate holes and the nuts are engaged with the screw portions while the abutting portions of the support bars are abutted against the front of the base frame, so that the support bars are fixed to the base frame while being maintained in a horizontal state, respectively.

6. A headgear holder according to claim 2, wherein each vertical position adjustment connecting mechanism includes a support bar provided on the base frame so as to extend forward from a front of the base frame and having a front end to which the headgear support plate is connected, the base frame has vertically elongate holes, and each support bar has a rear end provided with an insertion shaft inserted into one of the elongate holes of the base frame so as to be vertically movable and non-rotatable.

7. A headgear holder according to claim 6, wherein the support bars have abutting portions abutting the front of the base frame when the insertion shafts have been inserted into the elongate holes of the base frame, respectively and screw portions protruding in the rear of a back of the base frame when the insertion shafts have been inserted into the elongate holes of the base frame, respectively, the vertical position adjustment connecting mechanisms include nuts engageable with the screw portions respectively, and the insertion shafts are inserted into the elongate holes and the nuts are engaged with the screw portions while the abutting portions of the support bars are abutted against the front of the base frame, so that the support bars are fixed to the base frame while being maintained in a horizontal state, respectively.

8. A headgear holder according to claim 1, further comprising a pair of front-to-back position adjustment connecting mechanisms for connecting the headgear support plates so that front-to-back positions of the respective headgear support plates are adjustable relative to the base frame.

9. A headgear holder according to claim 1, wherein the rotating frame has an engaged portion formed in an outer periphery thereof, the base frame includes a supporting mechanism provided for supporting the rotating frame for rotation and having a plurality of guide members engaging the engaged portion of the rotating frame, and which further comprises a position adjusting mechanism for adjusting a front-to-back position of at least one of the guide members of the base frame.

10. A headgear holder according to claim 9, wherein at least one of the guide members of the base frame includes a lower guide member engaging the engaged portion of the rotating frame at a lower end of the rotating frame, and the position adjusting mechanism adjusts a front-to-back position of the lower guide member.

11. A headgear holder mounted on an embroidering machine including a body and a sewing-bed arm provided on the body so as to extend front-to-back with respect to the body, the headgear holder comprising:

a guide shaft secured to the body of the embroidering machine and extending along the sewing-bed arm;

a base frame supported on the guide shaft so as to be moved front-to-back;

an annular rotating frame supported on the base frame so as to be rotated;

a headgear holding member detachably attached to the rotating frame to hold the headgear;

an engaged portion formed in an outer periphery of the rotating frame;

a supporting mechanism provided on the base frame for supporting the rotating frame for rotation, the supporting mechanism having a plurality of guide members engaging the engaged portion of the rotating frame; and a position adjusting mechanism for adjusting a front-to-back position of at least one of the guide members of the supporting mechanism.

12. A headgear holder according to claim 11, wherein at least one of the guide members of the supporting mechanism includes a lower guide member engaging the engaged portion of the rotating frame at a lower end of the rotating frame, and the position adjusting mechanism adjusts a front-to-back position of the lower guide member.

13. A headgear holder according to claim 12, wherein the position adjusting mechanism includes a supporting mechanism provided on the base frame for supporting the guide member so that the front-to-back position of the guide member is adjusted, and a fixing mechanism for releasably fixing the guide member to the base frame.

14. A headgear holder according to claim 13, wherein each guide member of the supporting mechanism comprises a guide roller.

15. A headgear holder according to claim 14, wherein the supporting mechanism has a distal end provided with a stepped pin rotatably supporting each guide roller, the stepped pin having a proximal end inserted into the base frame.

16. A headgear holder according to claim 11, wherein the position adjusting mechanism includes a supporting mechanism provided on the base frame for supporting the guide member so that the front-to-back position of the guide member is adjusted, and a fixing mechanism for releasably fixing the guide member to the base frame.

17. A headgear holder according to claim 16, wherein each guide member of the supporting mechanism comprises a guide roller.

18. A headgear holder according to claim 17, wherein the supporting mechanism has a distal end provided with a stepped pin rotatably supporting each guide roller, the stepped pin having a proximal end inserted into the base frame.

19. A headgear holder according to claim 12, wherein each guide member of the supporting mechanism comprises a guide roller.

20. A headgear holder according to claim 11, wherein each guide member of the supporting mechanism comprises a guide roller.

21. A headgear holder mounted on an embroidering machine including a body and a sewing-bed arm extending front-to-back with respect to the body so that an embroidery is sewn on a headgear, the headgear holder comprising:

a guide shaft secured to the body of the embroidering machine and extending along the sewing-bed arm;

a base frame supported on the guide shaft so as to be moved front-to-back;

an annular rotating frame supported on the base frame so as to be rotated;

a headgear holding member detachably attached to the rotating frame to hold the headgear; and a pair of headgear support plates provided ahead of the rotating frame so as to be spaced from each other right and left with respect to the rotating frame so that positions of the headgear support plates are adjustable in at least two different directions independently of each other.

22. A headgear holder according to claim 21, further comprising a pair of vertical position adjustment connecting mechanism for connecting the headgear support plates so that the positions of the respective headgear support plates are vertically adjustable relative to the base frame.

23. A headgear holder according to claim 22, further comprising a pair of front-to-back position adjustment connecting mechanisms for connecting the headgear support plates so that front-to-back positions of the respective headgear support plates are adjustable relative to the base frame.

24. A headgear holder according to claim 23, wherein each vertical position adjustment connecting mechanism includes a support bar provided on the base frame as to extend forward from a front of the base frame and having a front end to which the headgear support plate is connected, the base frame has vertically elongate holes, and each support bar has a rear end provided with an insertion shaft inserted into one of the elongate holes of the base frame so as to be vertically movable and non-rotatable.

25. A headgear holder according to claim 24, wherein the support bars have abutting portions abutting the front of the base frame when the insertion shafts have been inserted into the elongate holes of the base frame, respectively and screw portions protruding in the rear of a back of the base frame when the insertion shafts have been inserted into the elongate holes of the base frame, respectively, the vertical position adjustment connecting mechanisms include nuts engageable with the screw portions respectively, and the insertion shafts are inserted into the elongate holes and the nuts are engaged with the screw portions while the abutting portions of the support bars are abutted against the front of the base frame, so that the support bars are fixed to the base frame while being maintained in a horizontal state, respectively.

26. A headgear holder according to claim 22, wherein each vertical position adjustment connecting mechanism includes a support bar provided on the base frame so as to extend forward from a front of the base frame and having a front end to which the headgear support plate is connected, the base frame has vertically elongate holes, and each support bar has a rear end provided with an insertion shaft inserted into one of the elongate holes of the base frame so as to be vertically movable and non-rotatable.

27. A headgear holder according to claim 26, wherein the support bars have abutting portions abutting the front of the base frame when the insertion shafts have been inserted into the elongate holes of the base frame, respectively and screw portions protruding in the rear of a back of the base frame when the insertion shafts have been inserted into the elongate holes of the base frame, respectively, the vertical position adjustment connecting mechanisms include nuts engageable with the screw portions respectively, and the insertion shafts are inserted into the elongate holes and the nuts are engaged with the screw portions while the abutting portions of the support bars are abutted against the front of the base frame, so that the support bars are fixed to the base frame while being maintained in a horizontal state, respectively.

28. A headgear holder according to claim 21, further comprising a pair of front-to-back position adjustment connecting mechanisms for connecting the headgear support plates so that front-to-back positions of the respective headgear support plates are adjustable relative to the base frame.

29. A headgear holder according to claim 21, wherein the rotating frame has an engaged portion formed in an outer periphery thereof, the base frame includes a supporting mechanism provided for supporting the rotating frame for rotation and having a plurality of guide members engaging the engaged portion of the rotating frame, and which further comprises a position adjusting mechanism for adjusting a front-to-back position of at least one of the guide members of the base frame.

30. A headgear holder according to claim 29, wherein at least one of the guide members of the base frame includes a lower guide member engaging the engaged portion of the rotating frame at a lower end of the rotating frame, and the position adjusting mechanism adjusts a front-to-back position of the lower guide member.

* * * * *